US007695162B2

(12) United States Patent
Zhang et al.

(10) Patent No.: US 7,695,162 B2
(45) Date of Patent: Apr. 13, 2010

(54) LED LAMP HAVING A PLURALITY OF HEAT SINKS

(75) Inventors: Yu Zhang, Shenzhen (CN); Wen-Xiang Zhang, Shenzhen (CN); Guang Yu, Shenzhen (CN); Cheng-Tien Lai, Taipei Hsien (TW)

(73) Assignees: Fu Zhun Precision Industry (Shen Zhen) Co., Ltd., Shenzhen, Guangdong Province (CN); Foxcomm Technology Co., Ltd., Tu-Cheng, Taipei Hsien (TW)

( * ) Notice: Subject to any disclaimer, the term of this patent is extended or adjusted under 35 U.S.C. 154(b) by 173 days.

(21) Appl. No.: 11/964,897

(22) Filed: Dec. 27, 2007

(65) Prior Publication Data

US 2009/0168417 A1 Jul. 2, 2009

(51) Int. Cl.
*F21V 29/00* (2006.01)

(52) U.S. Cl. ..... 362/294; 362/373; 362/545; 362/547

(58) Field of Classification Search ..... 362/294, 362/373, 545, 345, 547
See application file for complete search history.

(56) References Cited

U.S. PATENT DOCUMENTS

| | | | | |
|---|---|---|---|---|
| 6,729,747 | B1 * | 5/2004 | Wirayani | 362/356 |
| 7,434,964 | B1 * | 10/2008 | Zheng et al. | 362/294 |
| 2002/0122309 | A1 * | 9/2002 | Abdelhafez et al. | 362/294 |
| 2009/0046464 | A1 * | 2/2009 | Liu et al. | 362/294 |

* cited by examiner

*Primary Examiner*—Jong-Suk (James) Lee
*Assistant Examiner*—Robert J May
(74) *Attorney, Agent, or Firm*—Frank R. Niranjan

(57) ABSTRACT

An LED lamp includes a base, a top cover located above the base, a plurality of heat sinks spaced from each other and three LED modules respectively attached to inner sides of the three heat sinks. The heat sinks are sandwiched between base and the top cover and have a plurality of fins extending outwardly from outer sides thereof.

15 Claims, 3 Drawing Sheets

LED LAMP HAVING A PLURALITY OF HEAT SINKS

BACKGROUND OF THE INVENTION

1. Field of the Invention

The present invention relates to an LED lamp for a lighting purpose, and more particularly relates to an improved LED lamp providing even light.

2. Description of Related Art

An LED lamp is a type of solid-state lighting that utilizes light-emitting diodes (LEDs) as a source of illumination. An LED is a device for transferring electricity to light by using a theory that, if a current is made to flow in a forward direction through a junction region comprising two different semiconductors, electrons and holes are coupled at the junction region to generate a light beam. The LED has an advantage that it is resistant to shock, and has an almost eternal lifetime under a specific condition; thus, the LED lamp is intended to be a cost-effective yet high quality replacement for incandescent and fluorescent lamps.

Known implementations of LED modules in an LED lamp make use of a plurality of individual LEDs to generate light that is sufficient and of satisfactory spatial distribution. The large number of LEDs leads to a more expensive module and one with greater power consumption. The greater power usage leads to greater heat output, which, if not adequately addressed at additional expense, impacts the LED lamp reliability.

Besides, since the LEDs are generally arranged on a printed circuit board which having a flattened surface, the LEDs acting as a light source and arranged in this way usually are failed to provide a three-dimensional lamplight that suitable for a condition that needs soft and even light.

What is needed, therefore, is an improved LED lamp can overcome the above problems.

SUMMARY OF THE INVENTION

An LED lamp includes a base, a top cover located above the base, three heat sinks spaced from each other and three LED modules respectively attached to inner sides of the three heat sinks. The heat sinks are sandwiched between base and the top cover and have a plurality of fins extending outwardly from outer sides thereof. As the three LED modules are respectively face the three lampshades, light generated by the LED modules travel through the lampshades to illuminate area around the LED lamp, and thus is soften and evenly distributed to meet a specified requirement of illumination.

Other advantages and novel features will become more apparent from the following detailed description of preferred embodiments when taken in conjunction with the accompanying drawings, in which:

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION OF THE INVENTION

Figure 1:
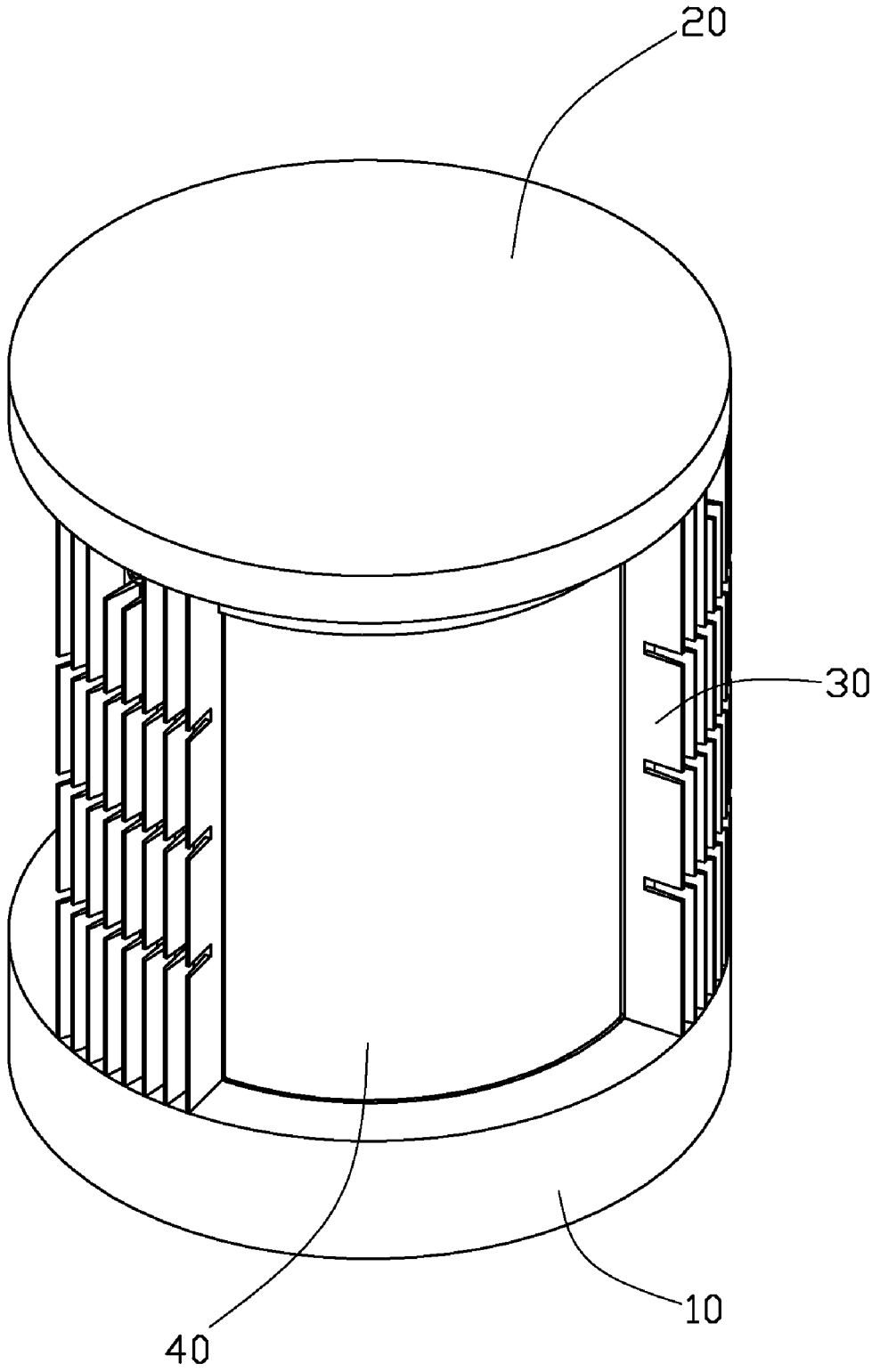
FIG. 1 is an isometric, assembled view of an LED lamp in accordance with a preferred embodiment of the present invention.
Figure 2:
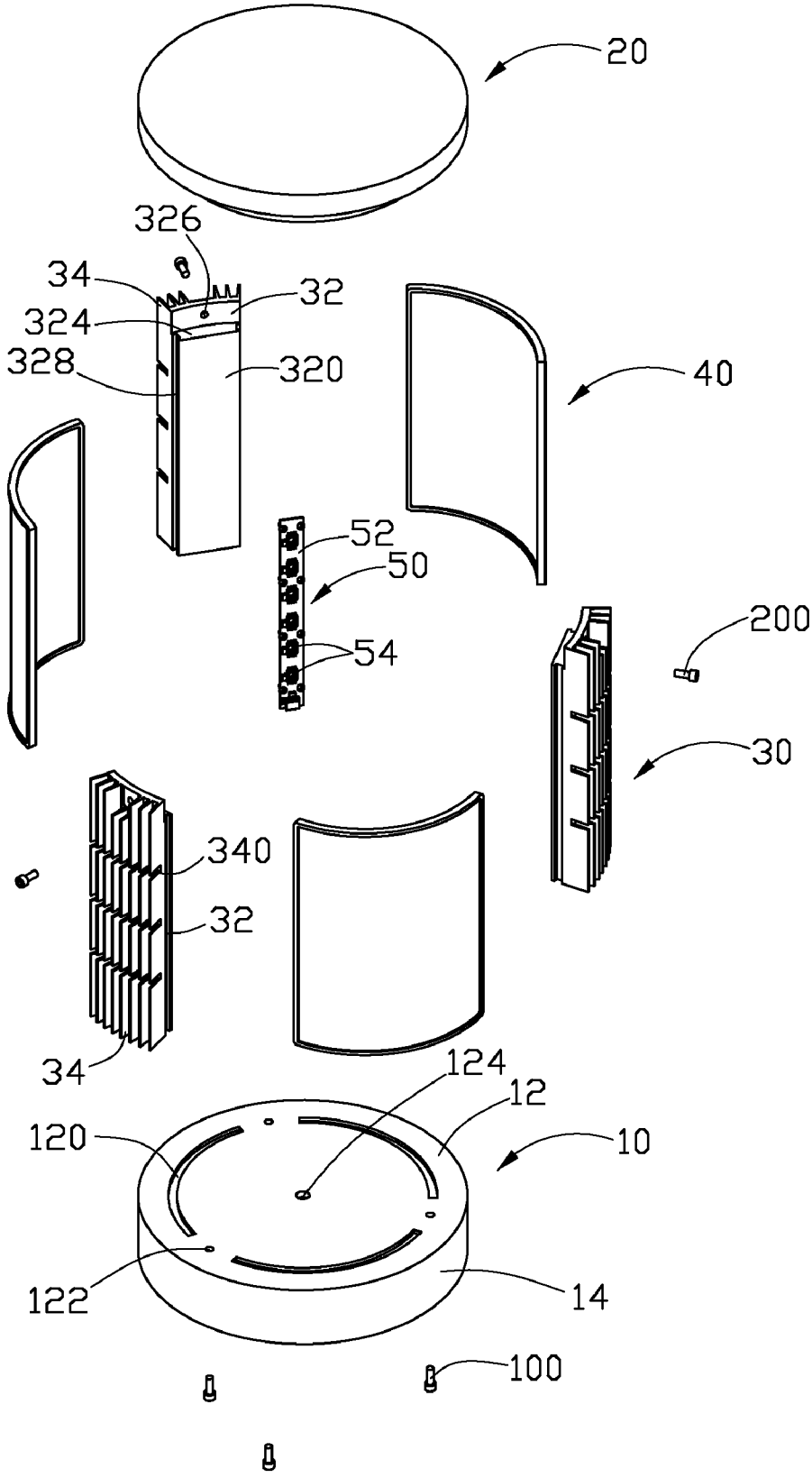
FIG. 2 is an exploded view of FIG. 1.
Figure 3:
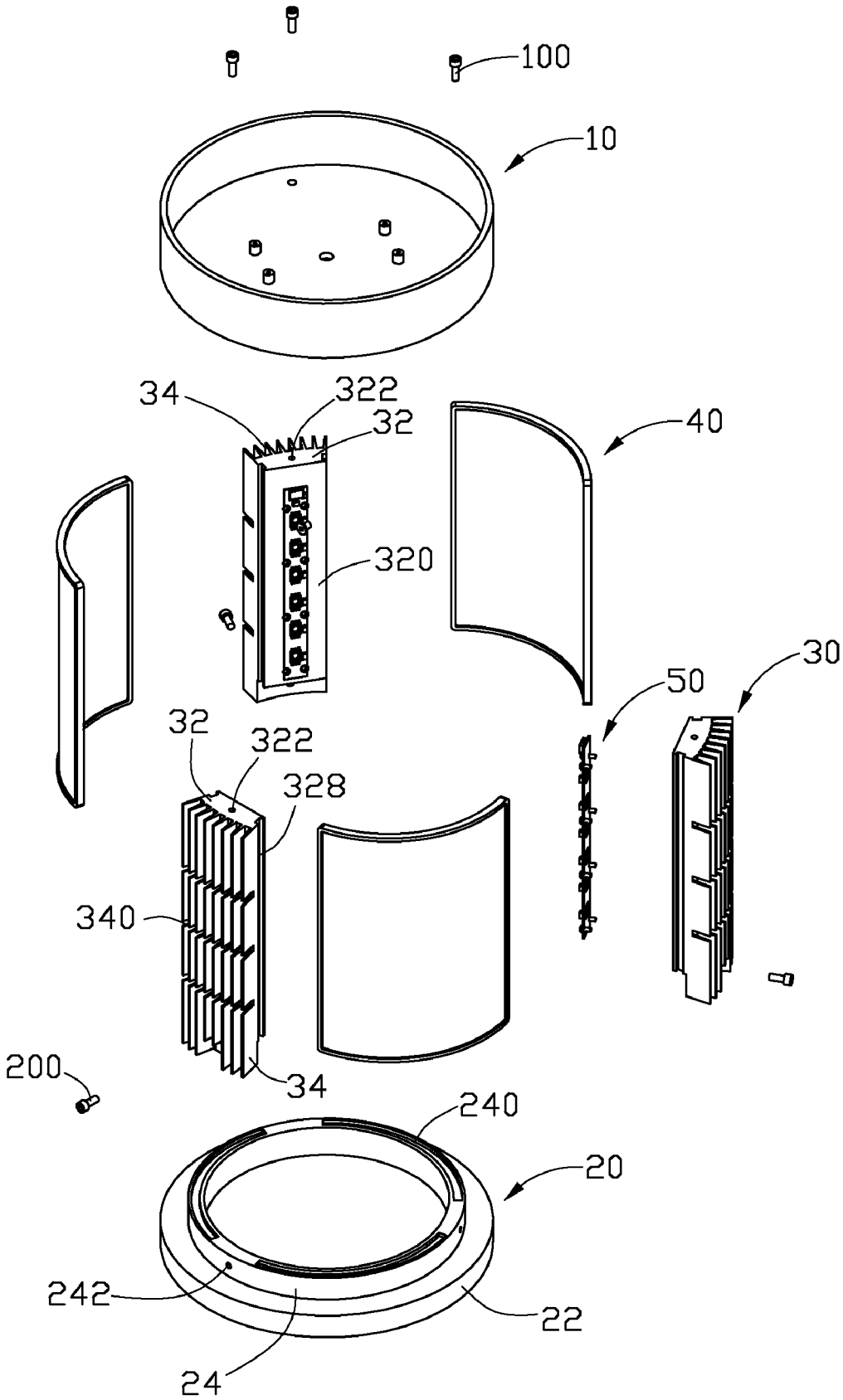
FIG. 3 is an inverted view of FIG. 2.

Referring to FIGS. 1-3, an LED lamp in accordance with a preferred embodiment is illustrated. The LED lamp comprises a base 10, a top cover 20 above the base 10, three heat sinks 30 located between the base 10 and the top cover 20, three lampshades 40 connected to two facing lateral sides of every two heat sinks 30 and three LED modules 50 respectively attached to inner sides of the heat sinks 30. A cylindrical space is defined by the alternated heat sinks 30 and lampshades 40.

The base 10 is formed integrally and configured to provide a solid support of the LED lamp. The base 10 comprises a circular base plate 12 and an annular sidewall 14 extending perpendicularly and downwardly from a rim of the base plate 12 such that the base 10 has a cylindrical configuration. The base plate 12 defines three arc-shaped receiving grooves 120 in top surface thereof. The three receiving grooves 120 are spaced from each other with a predetermined distance, arranged in a circle and adjacent to the rim of the base plate 12 for receiving bottom ends of the lampshades 40 therein. The base plate 12 therein defines three piercing orifices 122 between every two receiving grooves 120 for allowing screws 100 to extend through to screw into the heat sinks 30. The base plate 12 defines a through hole 124 in a centre thereof for allowing lead wires extending through to be electronically connected to the LED modules 50. The annular sidewall 14 is configured for engaging with a lamp holder (not shown) to securely hold the LED lamp in position.

Particularly referring to FIG. 3, the top cover 20 comprises a circle-shaped top plate 22 and a retaining ring 24 extending and perpendicularly and downwardly from a bottom surface of the top plate 22. The retaining ring 24 is located adjacent to a rim of the top plate 22 and centrosymmetrical relative to a central axes of the top plate 22. The retaining ring 24 defines three arc-shaped engaging grooves 240 at a bottom surface thereof. The engaging grooves 240 corresponds to the three receiving grooves 120 of the base 10 and for receiving top ends of the lampshades 40. Three engaging orifices 242 are defined in a sidewall of the retaining ring 24, located between every two engaging grooves 240 and configured to engage with screws 200 that extend through the heat sinks 30.

The heat sinks 30 are integrally formed of a metal material with a good heat conductivity such as aluminum, copper and alloy. The heat sinks 30 stand upright on the base 10 and are covered by the top cover 20. Each of the heat sinks 30 comprises a spreader 32 and a plurality of fins 34 extending outwardly from the spreader 32. The spreader 32 is perpendicular to the base plate 12 and the top plate 22 and located between every two of the receiving grooves of the base 10 and the corresponding engaging grooves 240 of top cover 20. The spreader 32 has an arc-shaped outer surface facing outwardly and a flat inner surface 320 facing inwardly. The spreader 32 defines a fixing orifice 322 in a centre of a bottom end thereof for engaging with the screw 100. Inner portion of a top end of the spreader 32 is cut away to form a step portion 324 thereon for supporting the retaining ring 24 of the top cover 20. The spreader 32 defines an extending orifice 326 in a centre of an upper portion thereof at the portion cut away. The extending orifice 326 is located above the step portion 324 and configured for allowing the screw 200 extending therethrough to screw into the corresponding engaging orifice 242. The spreader 32 defines two vertical engaging slots 328 in two opposite lateral sides thereof. The two engaging slots 328 extend along the corresponding two lateral sides of the spreader 32 from the bottom end of the spreader 32 until the step portion 324 of the spreader 32 and tightly receive lateral sides of the lampshades 40.

The fins 34 extend radially from the outer surfaces of the spreaders 30, are spaced from each other with predetermined distance and parallel to the two opposite lateral sides of the spreaders 32. A plurality of air passages is formed between every two neighboring fins 34 for allowing ambient air flow upwardly along the air passages when the LED lamp is powered on and placed in a proper position. A plurality of spaced channels 340 is defined in the fins 34 and perpendicular to the fins 34.

Each of the lampshades 40 is arc-shaped thin plate, rectangular in profile and made of transparent or semitransparent material such as glass and colophony. The lampshade 40 has a cushion worn on edge thereof. The lampshade 40 is configured for incorporate with the base 10, the top cover 20 and the heat sinks 30 to form a hermetic in the LED lamp.

Each of the LED modules 50 includes an elongated printed circuit board 52 attached to the inner surface 320 of the spreader 32 of the heat sink 30 and a plurality of LEDs 54 mounted on the printed circuit board 52. The LED modules 50 are arranged in a direction parallel to the fins 14 of the heat sinks 30 and respectively face one of the lampshades 40.

In assembly of the LED lamp, the LED modules 50 are attached to the inner surfaces 320 of the heat sinks 30 and have LEDs 54 pointing to the lampshades 40. The screws 100 extend through the piercing orifices 122 of the base 10 and screw into the fixing orifices 322 in the bottom end of the heat sinks 30 to vertically couple the heat sinks 30 to the base 10. The bottom surface of the retaining ring 24 of the top cover 20 is supported on the step portions 324 of the heat sinks 30 and an outer surface of the sidewall of the retaining ring 24 fitly abuts against the upper portions of the heat sinks 30 above the step portions 324. The screws 200 received in the extending orifices 326 are screwed into the engaging orifices 242 of the retaining ring 24 of the top cover 20 to securely couple the top cover 20 and the top ends of the heat sinks 30 together. The top and bottom ends of the lampshades 40 are respectively engaged into the engaging grooves 240 of the top cover 20 and the receiving grooves 120 of the base 10, the lateral sides of the lampshades 40 are received in the engaging slots 328 of the heat sinks 30. The LED lamp is thus assembled and the lampshades 40 and the heat sinks 30 are arranged alternately in circle to hermetically enclose the cylindrical space in the LED lamp.

In use of the LED lamp, as the three LED modules 50 are respectively face the three lampshades 40, light generated by the LED modules 50 travel through the lampshades 40 to illuminate area around the LED lamp, and thus is soften and evenly distributed to meet a specified requirement of illumination. Heat generated by the LED modules 50 is absorbed by the spreaders 32 of the heat sinks 30 and then delivered to the fins 34 to dissipate into ambient, the LED module 50 is thus cooled and maintain in allowing temperature.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An LED lamp, comprising:

a base;

a top cover located above the base;

a plurality of heat sinks spaced from each other, sandwiched between the base and the top cover and having a plurality of fins extending outwardly from outer sides thereof, the heat sinks being arranged in a circle and perpendicular to the base and the top cover, each of the heat sinks comprising a spreader which vertically stands on a top surface of the base and adjacent to a rim of the base;

a plurality of LED modules respectively attached to inner sides of the heat sinks; and a plurality of lampshades connected to two facing lateral sides of every two heat sinks;

wherein the lampshades have arc-shaped surfaces and are alternately in between two adjacent heat sinks along the circle in which the heat sinks are arranged.

2. The LED lamp as claimed in claim 1, wherein each of the spreaders has an arc-shaped outer surface from which the fins extend radially and a flat inner surface to which one of the LED modules is attached.

3. The LED lamp as claimed in claim 2, wherein the fins are spaced from each other, perpendicular to the top surface of the base and defines a plurality of vertical air passages between every two neighboring fins.

4. The LED lamp as claimed in claim 1, wherein engaging slots are defined in two opposite lateral sides of each of the heat sinks and receive lateral side of the lamp shades.

5. The LED lamp as claimed in claim 1, wherein the base comprises a circular base plate and an annular sidewall extending downwardly from a rim of the base plate, a plurality of arc-shaped receiving grooves are defined in a top surface of the base plate and receive bottom ends of the lampshades.

6. The LED lamp as claimed in claim 1, wherein the top cover comprises a circular top plate parallel to the base and a retaining ring extending downwardly from a bottom surface of the top plate.

7. The LED lamp as claimed in claim 6, wherein step portions are defined at upper ends of the spreaders of the heat sinks and support the retaining ring thereon.

8. The LED lamp as claimed in claim 7, wherein a plurality of engaging grooves are defined in a bottom end of the retaining ring for receiving top ends of the lampshades therein.

9. An LED lamp, comprising:

a base comprising a circular base plate and a sidewall extending downwardly from a rim of the base plate;

a top cover located above the base and comprising a circular top plate and a retaining ring extending downwardly from the top plate;

a plurality of heat sinks spaced from each other and each comprising a spreader having a top end coupled to the retaining ring and a bottom end coupled to the base plate, and a plurality of fins extending outwardly from the spreader;

a plurality of LED modules respectively attached to inner sides of the heat sinks; and a plurality of lampshades having upper ends attached to the retaining ring and bottom ends attached to the base plate;

wherein the heat sinks and the lampshades are alternately arranged in a circle.

10. The LED lamp as claimed in claim 9, wherein engaging slots are defined in two opposite lateral sides of each of the spreaders and receive lateral side of the lampshades.

11. The LED lamp as claimed in claim 9, wherein a plurality of arc-shaped receiving grooves are defined in a top surface of the base plate and receive bottom ends of the lampshades.

12. The LED lamp as claimed in claim 9, wherein step portions are defined at upper ends of the spreaders of the heat sinks and support the retaining ring thereon.

13. The LED lamp as claimed in claim 9, wherein a plurality of engaging grooves are defined in a bottom end of the retaining ring and received top ends of the lampshades therein.

14. An LED lamp, comprising:

a base;

a top cover located above the base;

a plurality of heat sinks spaced from each other, sandwiched between the base and the top cover and having a plurality of fins extending outwardly from outer sides thereof, the heat sinks being arranged in a circle;

a plurality of LED modules respectively attached to inner sides of the heat sinks; and a plurality of lampshades connected to two facing lateral sides of every two heat sinks;

wherein the lampshades have arc-shaped surfaces and are alternately in between two adjacent heat sinks along the circle in which the heat sinks are arranged.

15. The LED lamp as claimed in claim 14, wherein the LED modules face the lampshades, respectively.

* * * * *